US006835102B2

(12) United States Patent
Kayama

(10) Patent No.: US 6,835,102 B2
(45) Date of Patent: Dec. 28, 2004

(54) CONNECTOR PROVIDED WITH FRONT HOLDER

(75) Inventor: Shinobu Kayama, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 10/780,571

(22) Filed: Feb. 19, 2004

(65) Prior Publication Data

US 2004/0175994 A1 Sep. 9, 2004

(30) Foreign Application Priority Data

Mar. 7, 2003 (JP) ..... P2003-061857

(51) Int. Cl.[7] ..... H01R 13/502
(52) U.S. Cl. ..... 439/686; 439/752
(58) Field of Search ..... 439/686, 752

(56) References Cited

U.S. PATENT DOCUMENTS 5,607,327 A * 3/1997 Tsuji et al. ..... 439/752
5,820,417 A * 10/1998 Yamada ..... 439/686
6,045,410 A * 4/2000 Norizuki et al. ..... 439/701
6,120,331 A * 9/2000 Lin ..... 439/686
6,375,503 B2 * 4/2002 Ohsumi ..... 439/595
6,568,948 B2 * 5/2003 Matsuoka ..... 439/271
6,652,328 B2 * 11/2003 Suzuki ..... 439/752
6,702,626 B2 * 3/2004 Ichio ..... 439/752
6,702,628 B2 * 3/2004 Tanaka et al. ..... 439/752

* cited by examiner

*Primary Examiner*—Tho D. Ta
*Assistant Examiner*—Larisa Tsukerman
(74) *Attorney, Agent, or Firm*—Sughrue Mion, PLLC

(57) ABSTRACT

A partition wall defines a plurality of chambers adapted to accommodate terminals which are inserted from a rear end portion of a housing body. The partition wall is formed with a recessed part. A pair of opposite side walls and a bottom wall interconnecting the side walls define a recessed space at a front end portion of the housing body such that front ends of the terminals accommodated in the chambers are exposed therefrom. Each of the side walls is formed with a recessed part. A front holder is fitted into the recessed space in a first direction to cover the exposed front ends of the terminals. The front holder has a pair of first projections, each of which is formed with a first flat face facing in a second direction opposite to the first direction and extending in a third direction perpendicular to the first direction, and is adapted to be engaged with the recessed part of each of the side walls. The front holder has a second projection, which is formed with a second flat face facing in the second direction and extending in the third direction, and is adapted to be engaged with the recessed part of the partition wall.

2 Claims, 10 Drawing Sheets

CONNECTOR PROVIDED WITH FRONT HOLDER

BACKGROUND OF THE INVENTION

This invention relates to a connector in which a front holder is attached to a front end of a housing, receiving connection terminals therein, to cover distal ends (front ends) of the connection terminals.

Air bag devices have heretofore been used to protect automobile passengers from the impact of a collision. For inflating an air bag of the air bag device, an inflator of the air bag device is energized. When the inflator is energized, a propellant, contained in this inflator, is explosively burned, and expansion gas, produced as a result of this combustion, is introduced into the folded air bag to instantaneously inflate or expand the air bag.

A plurality of current-supplying wires extend outwardly from the inflator, and the inflator is electrically connected via these wires to a clock spring. A power source-side drive control unit for driving and controlling the inflator is electrically connected to the clock spring. When a potential difference due to electromagnetic waves or static electricity develops between the wires before the connection of the inflator, there is a possibility that the inflator malfunctions to cause the air bag to be inflated. Therefore, usually, short-circuiting resilient contacts (that is, short-circuiting springs) are contained in a connector provided at the distal end portions of the wires, each short-circuiting resilient contacts serving to short-circuit the mating connection terminals (secured respectively to the distal ends of the wires) together.

FIGS. 6 to 10 show one example of connectors containing the above-mentioned short-circuiting resilient contacts.

As shown in FIGS. 6 to 8, a plurality of terminal chambers 2*a*, separated from one another by partition walls 2*h*, are arranged in a row within a housing 2 of the connector 1. The connection terminals 3 (each having a wire W connected to a rear end thereof) for connecting an inflator and others to a power source are inserted respectively into the terminal chambers 2*a* through a rear end of the housing 2 in a direction of arrow A, and are received in these terminal chambers 2*a*, respectively.

The lance (that is, an elastic retainer) 2*b*, having its distal end portion projected into the terminal chamber 2*a* in the housing 2, is engaged in an engagement hole 3*a* formed in the connection terminal 3. Therefore, the connection terminal 3 is retained against withdrawal from the housing 2. The retaining member (that is, a spacer) 6 for retaining the connection terminals 3 in a double locking manner is inserted in a direction of arrow E into a recessed portion 2*c* formed in the housing 2. In this inserting operation, a distal end 6*a* of the retaining member 6 is engaged in engagement recesses 3*b* formed respectively in the connection terminals 3, thereby fixing the connection terminals 3 in a double locking manner within the housing 2.

A space 2*d* is formed in the housing 2, and is disposed below the terminal chambers 2*a*, and communicates with the terminal chambers 2*a*, and the short-circuiting resilient contacts 8 are received in the space 2*d*, and each short-circuiting resilient contact 8 contacts both of the pair of corresponding connection terminals 3 to short-circuit them together. The short-circuiting resilient contact 8 is formed by bending a metal sheet so as to have a roughly oval cross-sectional shape, and to have a pair of contact plate portions 8*a*. The pair of contact plate portions 8*a*, received in the space 2*d*, project respectively into the corresponding terminal chambers 2*a*, and contact the pair of connection terminals 3, respectively, to short-circuit them together.

As a result, there develops no potential difference between the pair of connection terminals 3, and therefore even if current due to electromagnetic waves or static electricity flows through the wires W when mounting an air bag device on a vehicle body of a vehicle, the air bag device (particularly the inflator) is prevented from malfunction. Mating connection terminals (not shown) and insulating plates (not shown) are provided in a power source-side mating connector (not shown) in which the connector 1 is adapted to be fitted. When the connector 1 is fitted in the mating connector, the connection terminals 3 are connected to the mating terminals, respectively, and at the same time the insulating plate is inserted between the connection terminal 3 and the short-circuiting resilient contact 8, thereby eliminating the short-circuiting effect by the short-circuiting resilient contact 8.

Generally, in an integrally-molded connector, the positional relation between terminal chambers and lances in a housing is such that each terminal chamber and the corresponding lance are spaced from each other in an upward-downward direction when viewed from the front or the side of the connector so that molds can be withdrawn from the molded housing. More specifically, terminal insertion ports (into which connection terminals of a mating connector are inserted, respectively) in a front wall of the housing and the lances are arranged such that each terminal insertion port does not overlap the corresponding lance in the upward-downward direction when viewed from the front side of the connector. With this arrangement, the ordinary connector is of such a construction that the front wall of the housing will not interfere with a mold for molding the lances when withdrawing this mold.

However, in order to meet a demand for a compact design of connectors in recent years, there has been proposed the type of connector in which a connector housing is divided into two separate parts, that is, a housing and a front holder, taking into consideration the withdrawing of a mold from the molded connector. The two parts are molded separately from each other, and thereafter are assembled together. One such example is the connector shown in FIGS. 6 to 10. Although a front wall 4*b* of the front holder 4 is disposed in overlapping relation to the lances 2*b* in the upward-downward direction as shown in FIG. 7, the front wall 4*b* of the front holder 4 will not interfere with the withdrawing of the mold since the front holder 4 and the housing 2 are separate from each other, and therefore the mold can be suitably designed. As a result, the dimension of the connector 1 in the upward-downward direction is reduced, so that the compact design of the connector 1 is achieved.

A plurality of terminal insertion ports 4*a* are formed in the front holder 4 as shown in FIG. 6, and when the connector 1 is fitted into the mating connector, the mating connection terminals (male connection terminals) are inserted into these terminal insertion ports 4*a*, respectively. As shown in FIGS. 9A to 9C, retaining projections 4*d* are formed on opposite side walls 4*c* of the front holder 4, respectively. Each retaining projection 4*d* is of a generally trapezoidal having slope faces 4*f* formed respectively at upper and lower portions thereof.

The housing 2 is formed by injection molding a synthetic resin in such a manner that a recessed space is formed at its front end portion. The recessed space is defined by opposite side walls 2*e* and a lower wall 2*f* interconnecting the opposite side walls 2*e*. As shown in FIGS. 6 and 10, engagement holes 2*g* are formed in the opposite side walls 2*e*, respectively. When the front holder 4 is inserted and fitted into the recessed space of the housing 2 in a direction of arrow B (see FIG. 7), the retaining projections 4*d* of the front holder 4 are engaged in the engagement holes 2*g*, respectively. As a result, the front holder 4 is fixed to the housing 2.

In the related-art connector 1, however, the front holder 4 is molded into such a shape that the height of the widthwise side portions of the front holder 4 is large (thick) while the height of the widthwise central portion is small (thin) as shown in FIG. 9A. Therefore, a pressing force, applied from the short-circuiting contact piece 8, acts on the front holder 4 through the connection terminals 3, and the widthwise central portion of the front holder 4 is urged in a direction of arrow C, and is deformed by creep into an arcuate shape.

And besides, when the force, acting in the direction (that is, in the direction of arrow C) to cancel the engagement of the front holder 4 with the housing 2, exceeds the force of engagement of the front holder 4 with the housing 2, the retaining projections 4*d* of the front holder 4 are disengaged respectively from the engagement holes 2*g* of the housing 2, which leads to an anxiety that the front holder 4 is disengaged from the housing 2.

SUMMARY OF THE INVENTION

It is therefore an object of the invention is to provide a connector which is compact in size, and is reliable such that a housing and a front holder can be positively kept engaged with each other.

In order to achieve the above object, according to the invention, there is provided a connector, comprising:

a housing body, comprising:

a partition wall for defining a plurality of chambers adapted to accommodate terminals which are inserted from a rear end portion of the housing body, the partition wall being formed with a recessed part; and a pair of opposite side walls and a bottom wall interconnecting the side walls, for defining a recessed space at a front end portion of the housing body such that front ends of the terminals accommodated in the chambers are exposed therefrom, each of the side walls being formed with a recessed part; and a front holder, fitted into the recessed space in a first direction to cover the exposed front ends of the terminals, the front holder comprising:

a pair of first projections, each of which is formed with a first flat face facing in a second direction opposite to the first direction and extending in a third direction perpendicular to the second direction, and is adapted to be engaged with the recessed part of each of the side walls of the housing body; and a second projection, formed with a second flat face facing in the second direction and extending in the third direction, and is adapted to be engaged with the recessed part of the partition wall of the housing body.

In such a configuration, the front holder fitted into the recessed space is retained therein by the first projections and the second projection. Accordingly, the front holder can be firmly engaged with the housing body.

Further, since the first and second faces extend in the direction perpendicular to the direction in which the front holder is detached from the recessed space. Accordingly, even if force for detaching the front holder from the recessed space is act on the front holder, such force can be received by the first and second flat faces engaged with the recess portions of the housing body. Therefore, the inadvertent disengagement between the housing body and the front holder can be avoided.

Preferably, a center portion of the front holder in a direction that the chambers are arranged is reinforced by increasing a dimension in the first direction.

In such a configuration, the front holder is less liable to be bent, and the amount of deformation of the front holder due to a temperature change and so on is reduced. Therefore, this is no anxiety that the front holder is disengaged from the housing body as a result of deformation of the front holder.

BRIEF DESCRIPTION OF THE DRAWINGS

The above objects and advantages of the present invention will become more apparent by describing in detail preferred exemplary embodiments thereof with reference to the accompanying drawings, wherein.

DETAILED DESCRIPTION OF THE INVENTION

One preferred embodiment of the present invention will now be described in detail with reference to the accompanying drawings.

As shown in FIGS. 1 to 5, a connector 10 of the invention differs from the related-art connector 1 shown in FIGS. 6 to 10 mainly in that the shape of a front holder and the shape of portions in a housing for engagement with the front holder are different from those of the connector 1. With respect to other portions, the connector 10 is generally similar in construction to the related-art connector 1.

Figure 1:
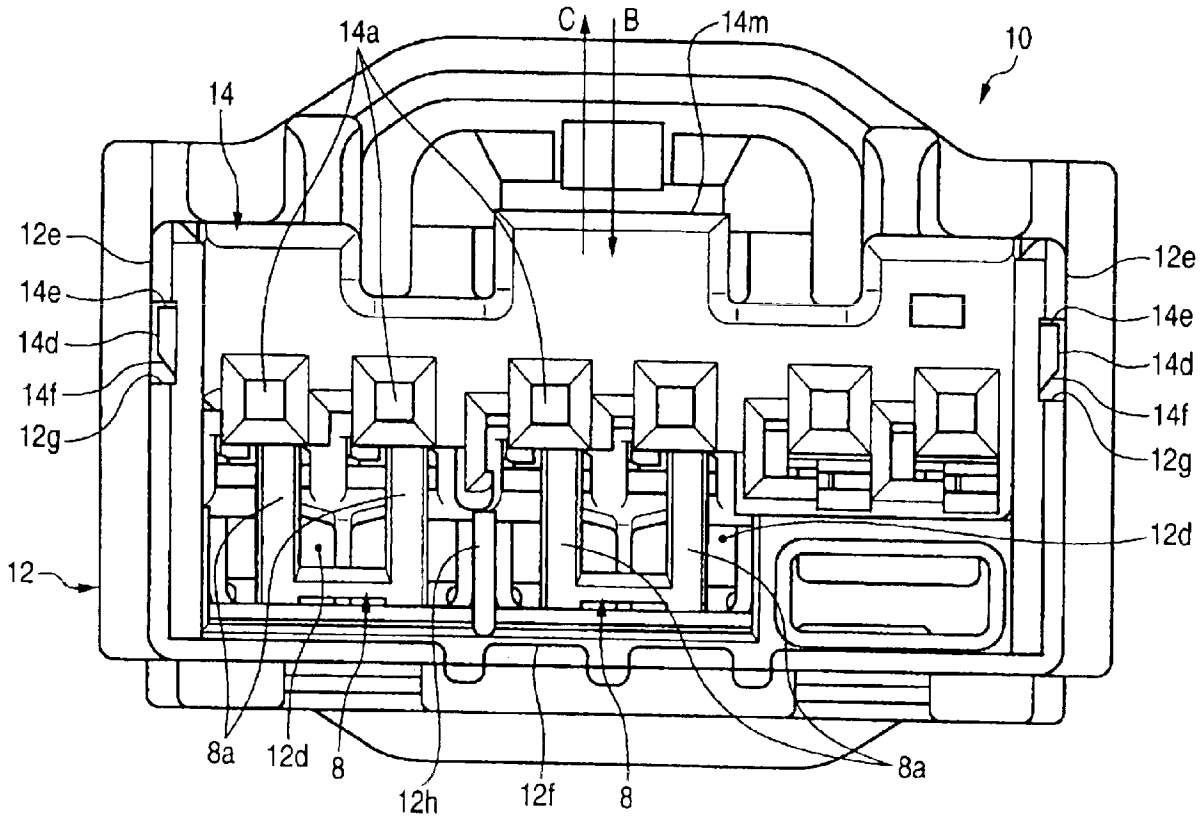
FIG. 1 is a front view of a connector according to one embodiment of the present invention, showing a condition that a front holder is fitted in a recessed space of a housing.

The connector 10 comprises a housing 12, a front holder 14, a retaining member (that is, a so-called spacer) 16, and connection terminals 3. As shown in FIGS. 1 to 0.3, the housing 12 is formed by injection molding a synthetic resin such as PBT (polybutylene terephthalate). A plurality of terminal chambers 12*a*, separated from one another by partition walls 12*h*, are arranged in a row within the housing 12. The connection terminals 3, each having a wire W connected to a rear end thereof, are inserted respectively into the terminal chambers 12*a* through a rear end of the housing 12 in a direction of arrow A, and are received in these terminal chambers 12*a*, respectively.

Cantilevered lances (that is, elastic retaining pieces) 12*b* are formed within the housing 2, and each lance 12*b*, having its distal end portion projected into the corresponding terminal chamber 12*a*, is engaged in an engagement hole 3*a* formed in the connection terminal 3. Therefore, the connection terminals 3 are retained against withdrawal from the housing 12. The retaining member 16 for cooperating with the lances 12*b* to retain the connection terminals 3 in a double locking manner is inserted into a recessed portion 12*c* formed in the housing 12. In this inserting operation, a distal end 16*a* of the retaining member 16 is engaged in engagement recesses 3*b* formed respectively in the connection terminals 3, thereby fixing the connection terminals 3 in a double locking manner within the housing 12.

A space 12*d* is formed in the housing 12, and is disposed below the terminal chambers 12*a*, and this space 12*d* communicates with the terminal chambers 12*a*. The short-circuiting resilient contacts 8 are received in the space 12*d*, and each short-circuiting resilient contact 8 contacts both of the pair of corresponding connection terminals 3 to short-circuit them together. The short-circuiting resilient contact 8 is formed by bending a metal sheet so as to have a generally oval cross-sectional shape, and to have a pair of contact plate portions 8*a*. The pair of contact plate portions 8*a*, received in the space 12*d*, project respectively into the corresponding terminal chambers 12*a*, and contact the pair of connection terminals 3, respectively, to short-circuit them together.

As a result, there develops no potential difference between the pair of connection terminals 3, and therefore even if current due to electromagnetic waves or static electricity flows through the wires W when mounting an air bag device on a vehicle body, the air bag device (particularly an inflator) is prevented from malfunction. Mating connection terminals (not shown) and insulating plates (not shown) are provided in a power source-side mating connector (not shown) in which the connector 10 is adapted to be fitted. When the connector 10 is fitted in the mating connector, the connection terminals 3 are electrically connected to the mating terminals, respectively, and at the same time the insulating plate is inserted between the connection terminal 3 and the short-circuiting resilient contact 8, thereby eliminating the short-circuiting effect by the short-circuiting resilient contact 8.

As shown in FIGS. 1 through 4C, a recessed space is formed in a front end portion of the housing 12. The recessed space is defined by opposite side walls 12*e* and a lower wall 12*f* interconnecting the opposite side walls 12*e*. The front holder 4 is formed by injection molding a synthetic resin such as PBT, and this front holder 4 is fitted in the recessed space of the housing 12, and is disposed between the opposite side walls 12*e* to cover the front end portions of the connection terminals 3 received respectively in the terminal chambers 12*a*.

A plurality of terminal insertion ports 14*a* are formed in the front holder 14, and when the connector 10 is fitted into the mating connector (not shown), the mating connection terminals are inserted into these terminal insertion ports 14*a*, respectively. First retaining projections 14*d* are formed on opposite side walls 14*c* of the front holder 14, respectively. The first retaining projections 14*d* serve to fix the front holder 14 to the housing 12. A slope face 14*f* is formed at a lower portion of each retaining projection 14*d*. Hereinafter, a forward-side of the front holder 4 in a direction (i.e., direction of arrow B) of insertion thereof into the housing 12 will be referred to as "the lower side (lower portion)", while a rearward-side in the inserting direction will be referred to as "the upper side (upper portion)". In other words, the leading side of each portion in the direction of attaching of the front holder 14 to the housing 12 will be referred to as "the lower side", while the leading side of each portion in the direction of disengagement of the front holder 14 from the housing 12 will be referred to as "the upper side". A first retaining face 14*e* is formed on an upper face of the first retaining projection 14*d*. The first retaining face 14*f* is defined by a flat face perpendicular to the direction (i.e., the direction of arrow B or the direction of arrow C) of attaching and detaching of the front holder 14 relative to the housing 12.

Two second retaining projections 14*g* are formed on and project from a reverse face 14*p* of the front holder 14. A second retaining face 14*h* is formed on an upper face of the second retaining projection 14*g*, and is disposed perpendicular to the direction (i.e., the direction of arrow B or the direction of arrow C) of attaching and detaching of the front holder 14 relative to the housing 12. A lower portion of the second retaining projection 14*g*, extending from the second retaining face 14*h*, is formed into a rounded face viewed from the side thereof. A reinforcing rib 14*m* is formed at an upper portion of a widthwise-central portion of the front holder 14.

Figure 5:
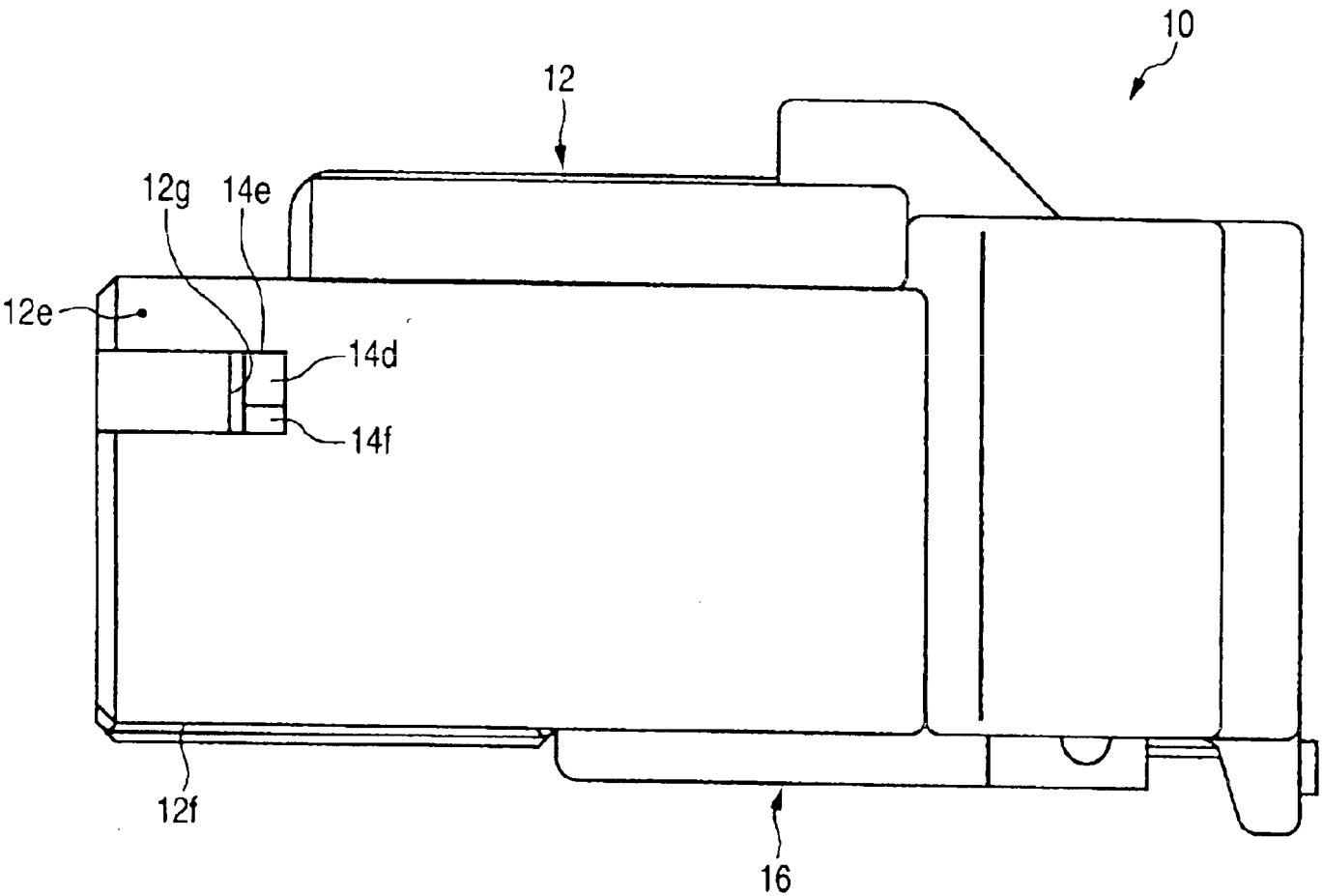
FIG. 5 is a side view of an external appearance of the connector.
Figure 6:
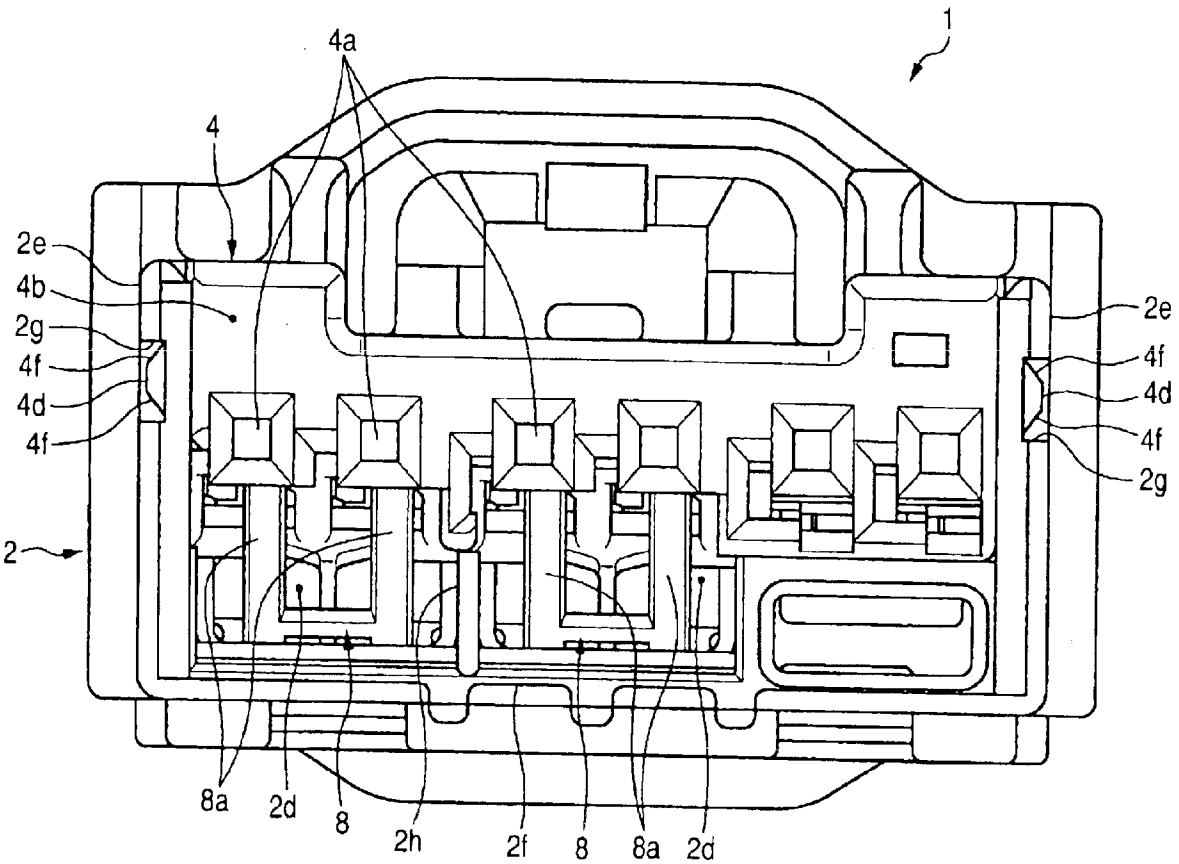
FIG. 6 is a front view of a related-art connector, showing a condition that a front holder is fitted in a recessed space of a housing.
Figure 7:
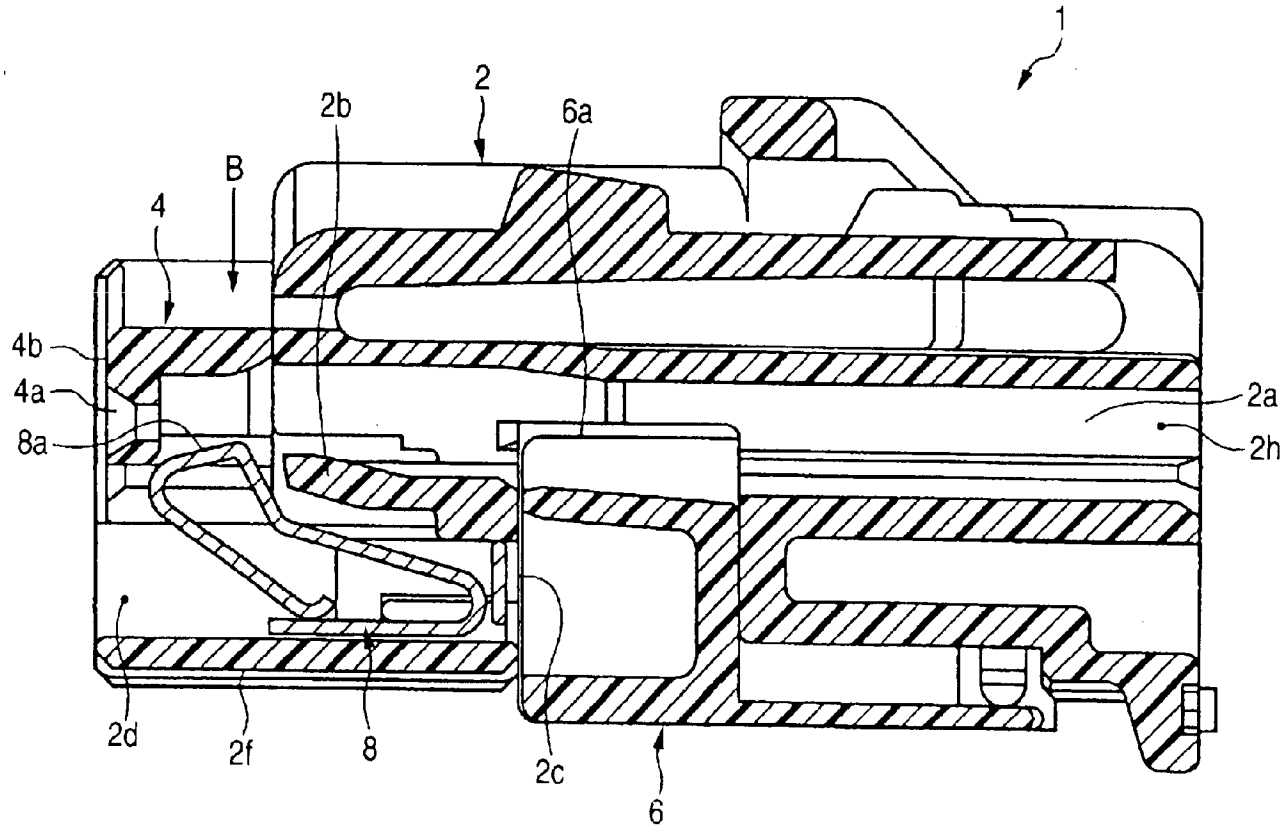
FIG. 7 is a longitudinal cross-sectional view of the related-art connector.
Figure 8:
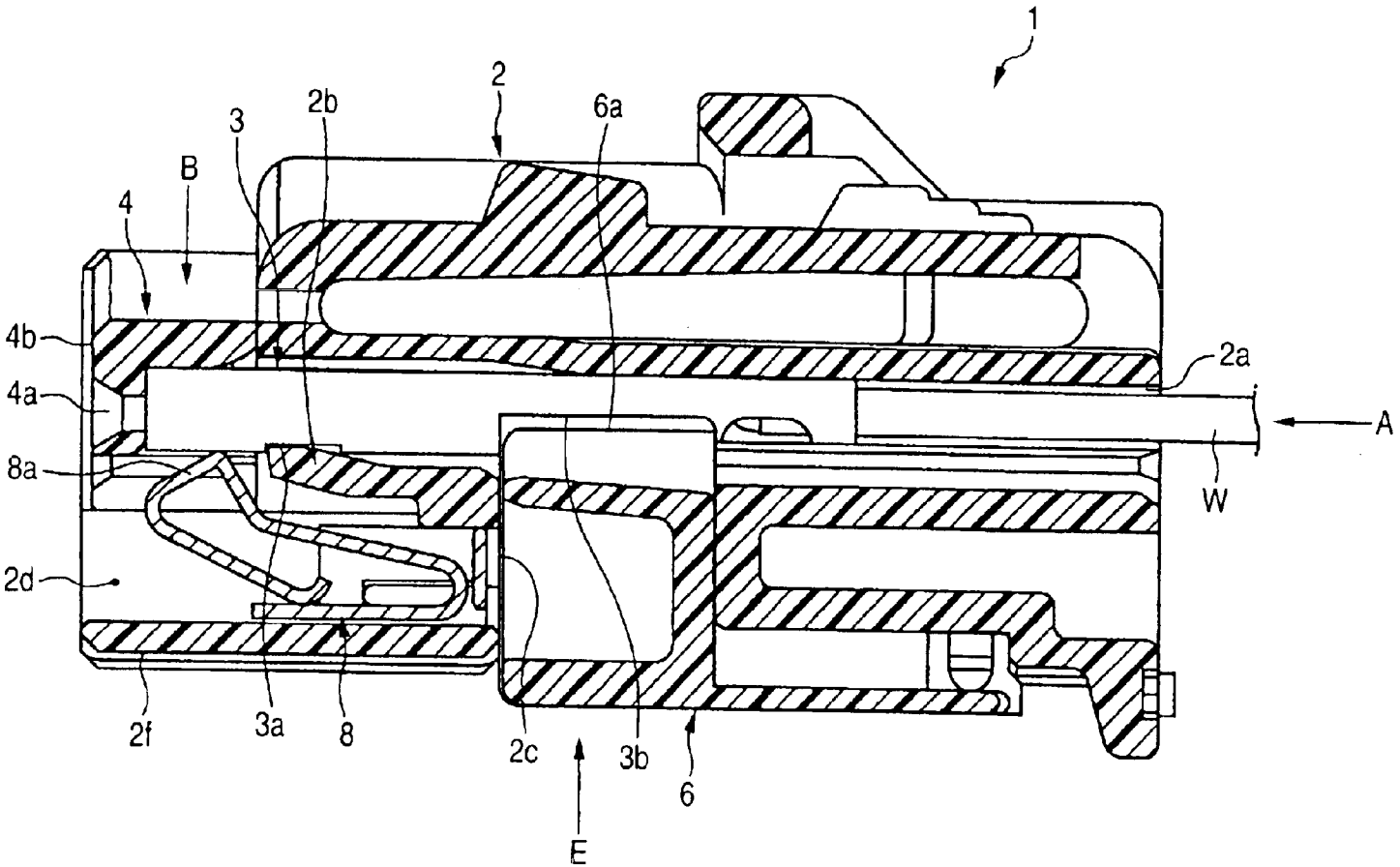
FIG. 8 is a longitudinal cross-sectional view of the related-art connector, showing a condition that connection terminals are received in respective terminal chambers.
Figure 9C:
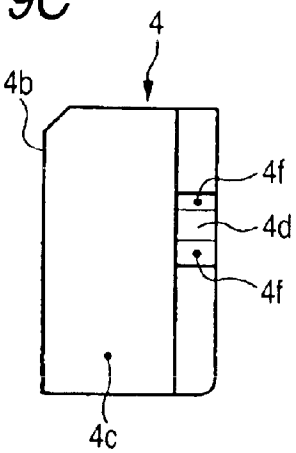
FIG. 9C is a side view of the front holder of the related-art connector.
Figure 9A:
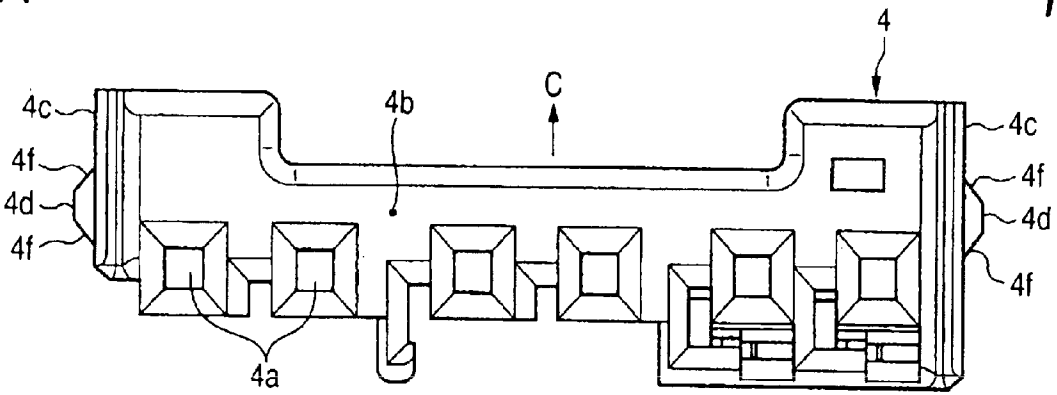
FIG. 9A is a front view of the front holder of the related-art connector.
Figure 9B:
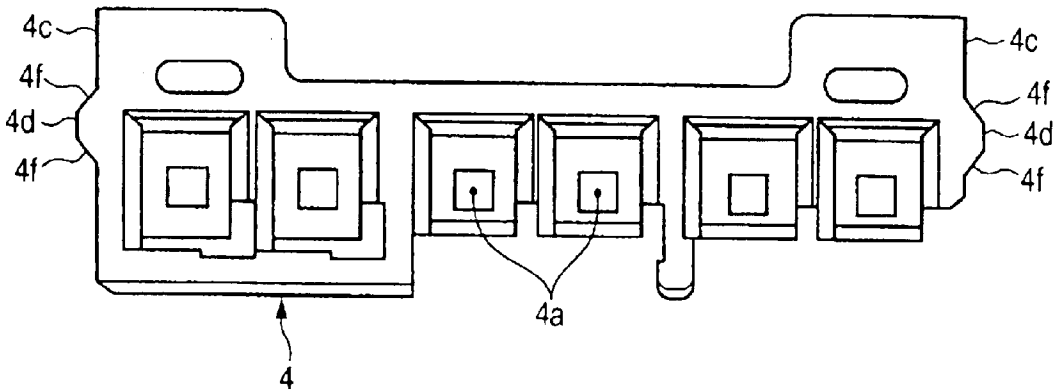
FIG. 9B is a rear view of the front holder of the related-art connector.
Figure 10:
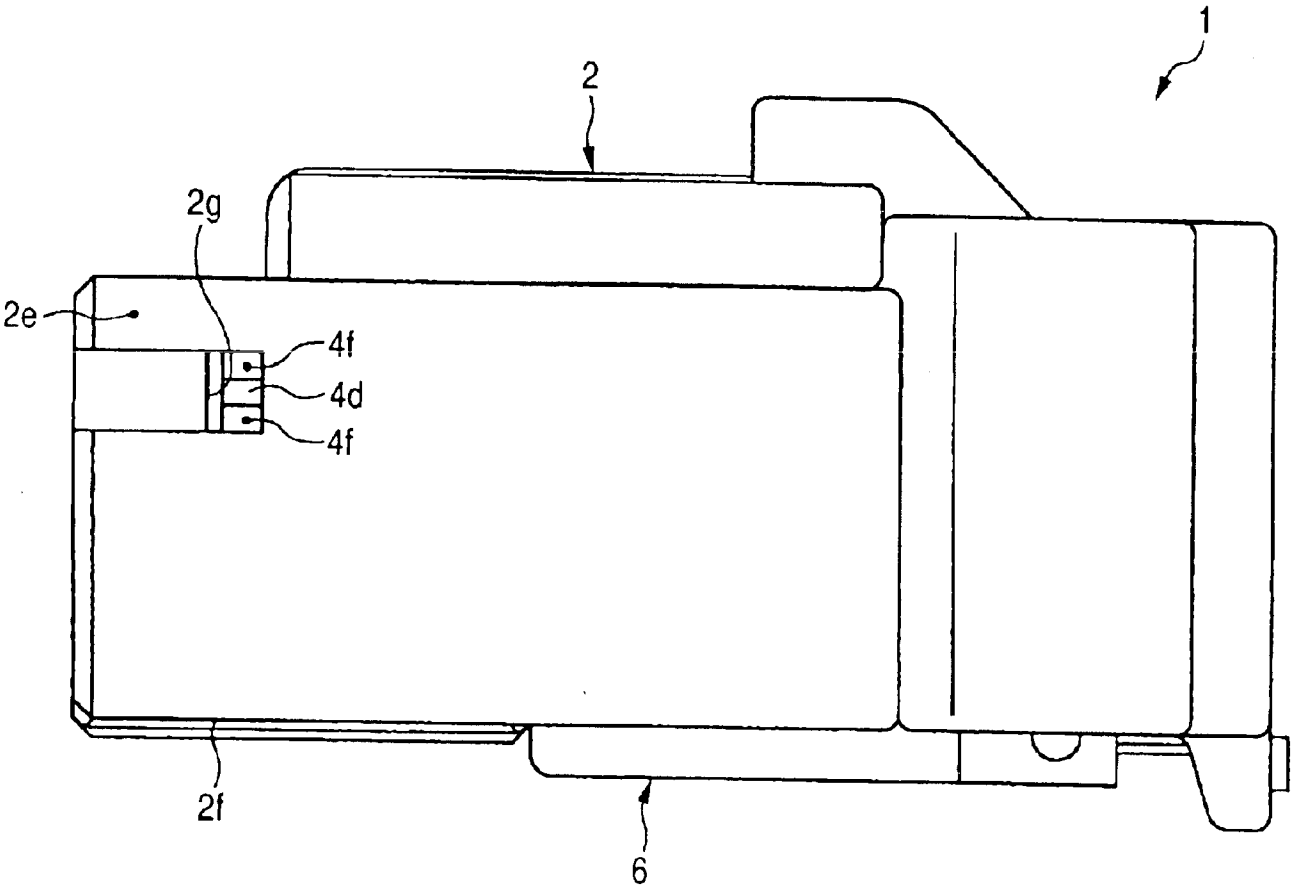
FIG. 10 is a side view of an external appearance of the related-art connector.

As shown in FIGS. 1 and 5, engagement holes 12*g* of a rectangular shape are formed in the opposite side walls 2*e* of the front end portion of the housing 12, respectively. When the front holder 14 is inserted and fitted into the recessed space of the housing 12 in the direction of arrow B, the first retaining faces 14*e* of the front holder 4 are engaged with upper edges of the engagement holes 12*g*, respectively.

Figure 2:
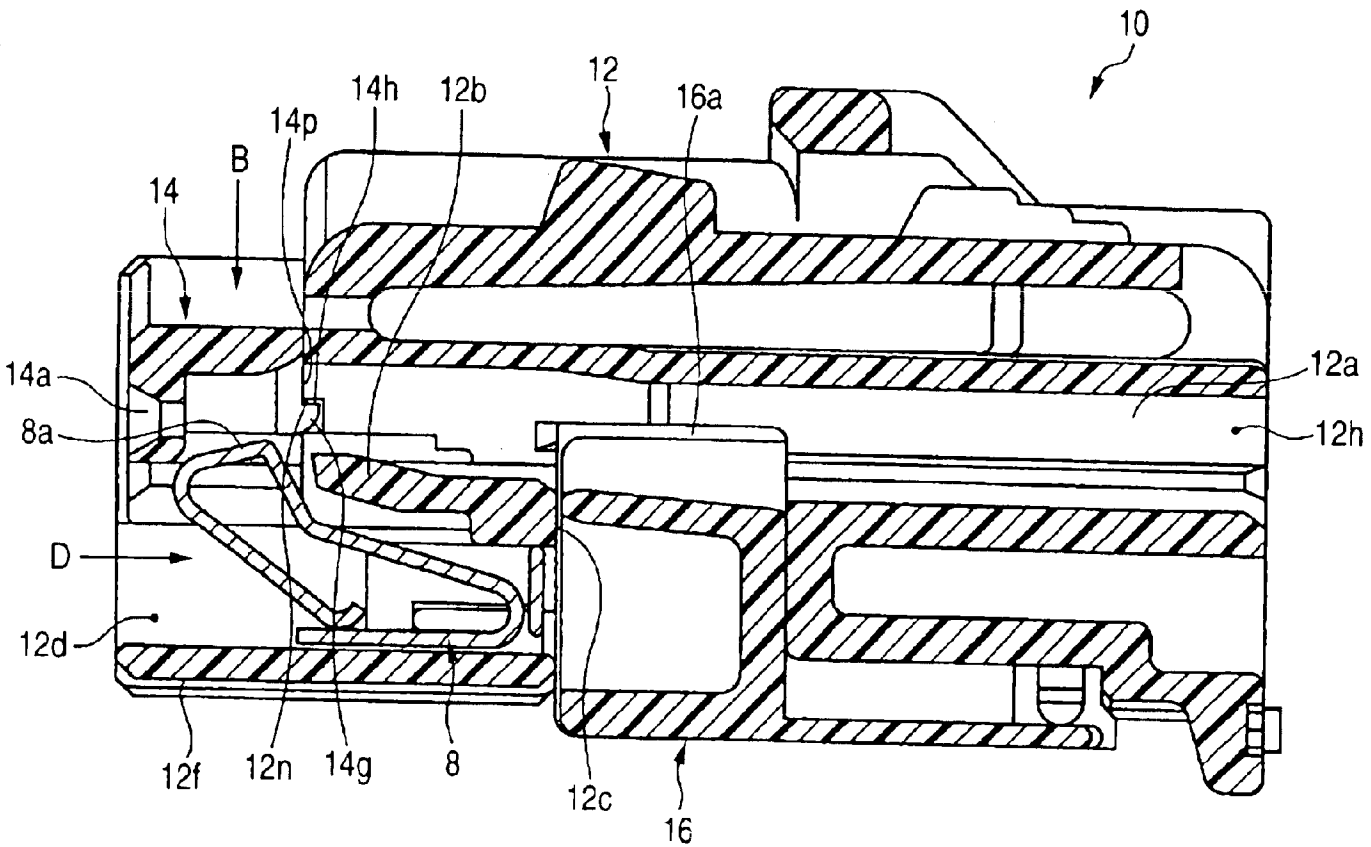
FIG. 2 is a longitudinal cross-sectional view of the connector.

As shown in FIG. 2, two of the partition walls 12*h*, exposed at the front end of the housing 12, are notched to provide engagement portions 12*n*, respectively. The engagement portions 12*n* are adapted to be engaged respectively with the second retaining faces 14*h* formed respectively on the second retaining projections 14*g* of the front holder 14. With this construction, the front holder 14 can be fitted in the recessed space of the housing 12, and can be fixed to this housing.

Figure 3:
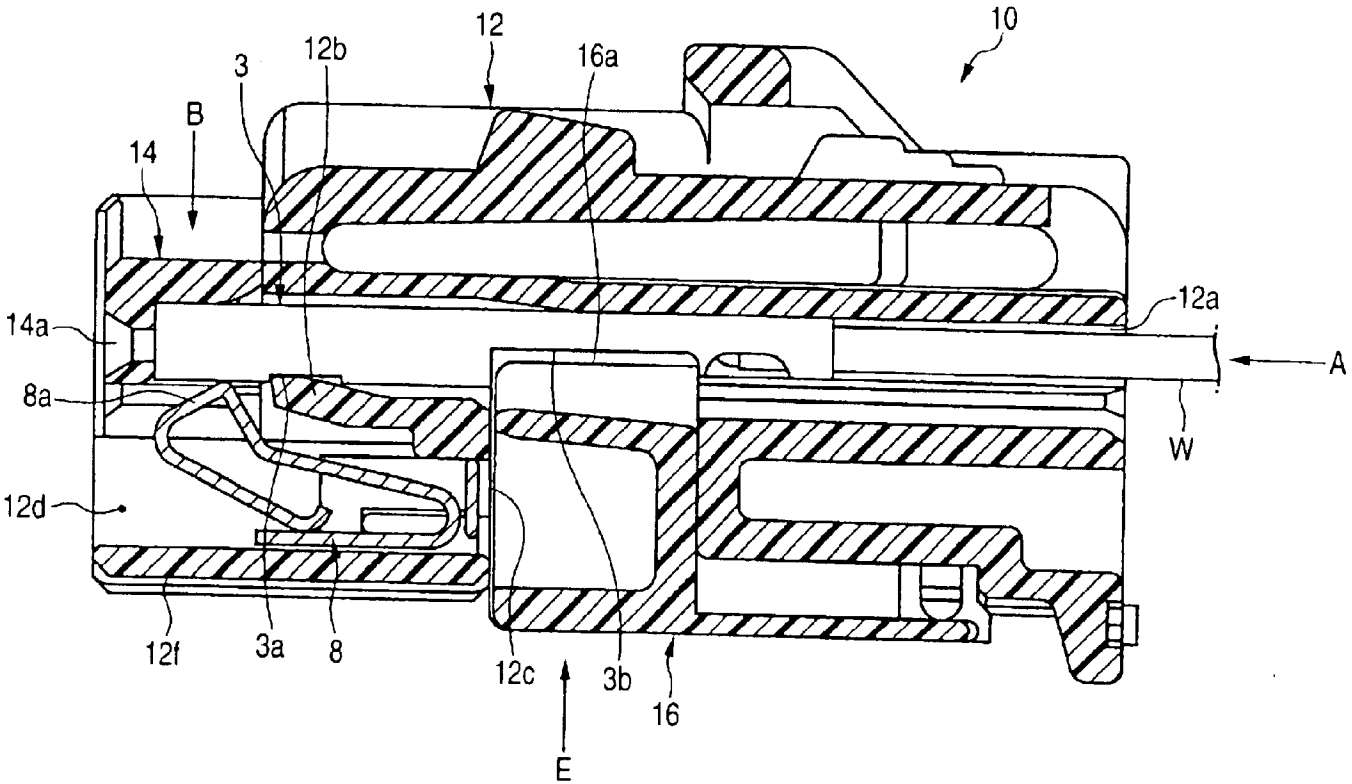
FIG. 3 is a longitudinal cross-sectional view of the connector, showing a condition that connection terminals are received in respective terminal chambers.
Figure 4C:
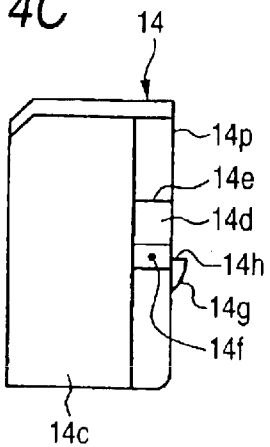
FIG. 4C is a side view of the front holder.
Figure 4A:
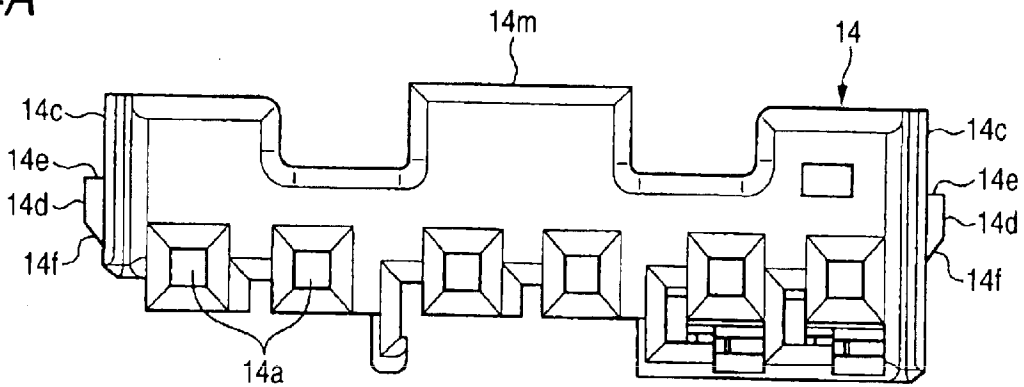
FIG. 4A is a front view of the front holder.
Figure 4B:
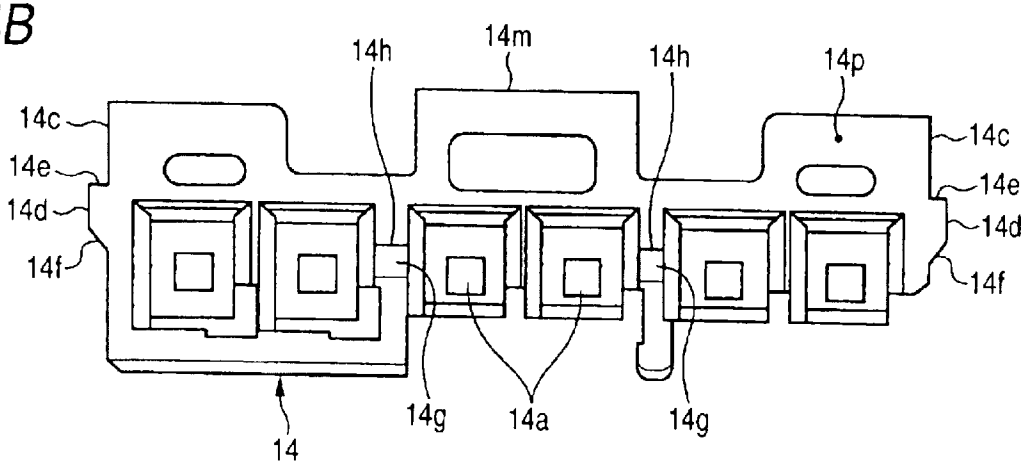
FIG. 4B is a rear view of the front holder.

The short-circuiting resilient contacts 8 are inserted into the space 12*d* in the direction of arrow D from the front side of the housing 12 as shown in FIG. 2. The pair of contact plate portions 8*a* of each short-circuiting resilient contact 8 project into the corresponding terminal chambers 12*a*, respectively. Then, when the connection terminals 3, electrically connected respectively to the wires W, are inserted respectively into the terminal chambers 12*a* in the direction of arrow A from the rear side of the housing 12 as shown in FIG. 3, the pair of contact plate portions 8*a* contact the lower faces of the pair of corresponding connection terminals 3, respectively, to short-circuit these connection terminals 3 together. As a result, there develops no potential difference between the pair of connection terminals 3, so that the air bag device (particularly the inflator) is prevented from malfunction even if current due to electromagnetic waves or static electricity flows through the wires W when mounting the air bag device on the vehicle body.

Each lance 12*b*, formed on the housing 12, is engaged in the engagement hole 3*a* in the corresponding connection terminal 3 received in the terminal chamber 12*a*, thereby preventing the rearward withdrawal of the connection terminal 3 from the housing 12. Further, the retaining member 16 is inserted in a direction of arrow E into the insertion portion 12*c* formed in the housing 12, and the distal end 16*a* of this retaining member is brought into engagement with the engagement recesses 3*b* formed respectively in the connection terminals 3, thereby fixing the connection terminals 3 in a double-retained condition within the housing 2.

When the front holder 14 is fitted into the recessed space of the housing 12, and is pressed in the direction of arrow B, the slope face 14*f* of each first retaining projection 14*d* and a straight portion thereof, extending from the slope face 14*f*, sequentially pass the upper edge of the corresponding engagement hole 12*g* formed in the housing 12, and then the first retaining projection 14*d* becomes completely fitted into the engagement hole 12*g*, so that the first retaining face 14*e* of the first retaining projection 14*d* is engaged with the upper edge of the engagement hole 12*g*, as shown in FIGS. 1, 3 and 5. At the same time, the rounded portion of each second retaining projection 14*g*, formed on the front holder 14, slides over the corresponding partition wall 12*h* of the housing 12, and the second retaining portion 14*h* thereof is engaged with the engagement portion (step portion) 12*n*.

Namely, the first retaining projections 14*d* are engaged respectively in the engagement holes 12*g*, and also the second retaining projections 14*g* are engaged respectively with the engagement portions 12*n*, thereby fixing the housing 12 and the front holder 14 together. The first retaining face 14*e* of each first retaining projection 14*d* and the second retaining face 14*h* of each second retaining projection 14*g* are extended perpendicular to the direction (i.e., the direction of arrow B or the direction of arrow C) of attaching and detaching of the front holder 14 relative to the housing 12, that is, perpendicular to the direction (direction of arrow C) of disengagement of the front holder 14 from the housing 12, and therefore the first and second retaining faces 14*e* and 14*h* provide an extremely large resistance against this disengaging force. Therefore, the front holder 14 covers the front end portions of the connection terminals 3, and is firmly fixed to the housing 12, and will not be separated from the housing 12. On the other hand, the front holder 14 can be attached to the housing 12 with a relatively small force since the slope faces are formed respectively at the lower portions of the first retaining projections 14*d* and second retaining projections 14*g*.

The strength of the front holder 14 is increased by the reinforcing rib 14*m* formed at the upper portion of the widthwise-central portion of the front holder 14, and therefore the front holder 14 is less liable to be bent, and the amount of deformation of the front holder 14 due to a temperature change and so on is reduced. Therefore, this is no anxiety that the front holder 14 is disengaged from the housing 12 as a result of deformation of the front holder 14, and the front holder 14 and the housing 12 are positively kept in the mutually-engaged condition.

The present invention is not limited to the above embodiment, and suitable modifications, improvements, etc., can be made. The material, shape, dimensions, numerical value, form, number, mounting position, etc., of each of the constituent elements of the above embodiment are arbitrary, and are not limited in so far as the invention can be achieved.

In the above embodiment, although the invention is applied to the male connector, the invention is not limited to such a male connector, but can be applied to a female connector.

What is claimed is:

1. A connector, comprising:

a housing body, comprising:

a partition wall for defining a plurality of chambers adapted to accommodate terminals which are inserted from a rear end portion of the housing body, the partition wall being formed with a recessed part; and a pair of opposite side walls and a bottom wall interconnecting the side walls, for defining a recessed space at a front end portion of the housing body such that front ends of the terminals accommodated in the chambers are exposed therefrom, each of the side walls being formed with a recessed part; and a front holder, fitted into the recessed space in a first direction to cover the exposed front ends of the terminals, the front holder comprising:

a pair of first projections, each of which is formed with a first flat face facing in a second direction opposite to the first direction and extending in a third direction perpendicular to the first direction, and is adapted to be engaged with the recessed part of each of the side walls of the housing body; and a second projection, formed with a second flat face facing in the second direction and extending in the third direction, and is adapted to be engaged with the recessed part of the partition wall of the housing body.

2. The connector as set forth in claim 1, wherein a center portion of the front holder in a direction that the chambers are arranged is reinforced by increasing a dimension in the first direction.

* * * * *